United States Patent [19]

Kimball

[11] Patent Number: 5,064,345

[45] Date of Patent: Nov. 12, 1991

[54] MULTI-SWEEP BLADE WITH ABRUPT SWEEP TRANSITION

[75] Inventor: Richard Kimball, South Berwick

[73] Assignee: Airflow Research and Manufacturing Corporation, Watertown, Mass.

[21] Appl. No.: 438,774

[22] Filed: Nov. 16, 1989

[51] Int. Cl.[5] ..... F04D 29/38

[52] U.S. Cl. ..... 416/169 A; 416/192; 416/DIG. 5

[58] Field of Search ..... 416/169 A, 189, 192, 416/195, 228, 238, DIG. 2, DIG. 5

[56] References Cited

U.S. PATENT DOCUMENTS

| | | | |
|---|---|---|---|
| 1,146,121 | 7/1915 | Amnelius | 416/238 X |
| 1,825,114 | 9/1931 | Hendrickson | 416/228 R |
| 2,212,041 | 8/1940 | Pfautsch | 416/228 R |
| 3,826,591 | 7/1974 | Wilson | 416/189 R X |
| 3,972,646 | 8/1976 | Brown et al. | 416/228 R |
| 4,358,245 | 11/1982 | Gray | 416/189 R |
| 4,459,087 | 7/1984 | Barge | 416/189 R X |
| 4,505,641 | 3/1985 | Tsuchikawa et al. | 416/189 R |
| 4,569,631 | 2/1986 | Gray | 416/DIG. 2 X |
| 4,569,632 | 2/1986 | Gray | 416/189 R |
| 4,684,324 | 8/1987 | Perosino | 416/DIG. 2 X |
| 4,685,513 | 8/1987 | Longhouse et al. | 416/189 |
| 4,729,714 | 3/1988 | Wrobel | 416/200 |
| 4,840,541 | 6/1989 | Sakane et al. | 416/DIG. 2 X |

FOREIGN PATENT DOCUMENTS

| | | | |
|---|---|---|---|
| 0168594 | 1/1986 | European Pat. Off. . | |
| 228072 | 1/1925 | United Kingdom | 416/189 R |

*Primary Examiner*—Edward K. Look
*Assistant Examiner*—James A. Larson

[57] ABSTRACT

A blade for a fan or blower which has an abrupt transition region between an inner blade region which has a negative leading edge sweep angle, and an outer blade region which is highly forwardly swept. The outer blade region is further characterized by a blade chord that increases with increasing radius. The fan provides a low pitch width and superior noise and efficiency tradeoffs.

10 Claims, 4 Drawing Sheets

MULTI-SWEEP BLADE WITH ABRUPT SWEEP TRANSITION

BACKGROUND OF THE INVENTION

This invention is generally related to blowers or fans such as those used adjacent to a heat exchanger or in forced-air heating.

Gray U.S. Pat. No. 4,358,245 discloses a fan with highly forwardly skewed blades that generate less noise than comparable radial (straight) blades.

Gray U.S. Pat. No. 4,569,632 discloses a fan with rearwardly skewed blades which also exhibit less noise. To compensate for the rearward skew, the blade pitch decreases with increasing radius.

Gray U.S. Pat. No. 4,569,631 discloses a fan which has a highly forwardly skewed (leading edge skew) blades at the tip (where velocity and therefore noise are highest). The fan exhibits good strength due to an initial rearward blade skew at the root, which results in a relatively low overall (root-to-tip) offset.

Pezeshkzad, EP 0,168,594 discloses a fan with a blade chord that increases as a function of radius over the outer 80% of the blade and a blade thickness which increases as a function of radius over the outer 30% of the blade.

Perosuro U.S. Pat. No. 4,684,324 discloses a fan with blades having a high forward skew at the tip and an initial rearward skew toward the blade root.

SUMMARY OF THE INVENTION

The invention generally features a blade design for a fan or blower which includes an abrupt transition region between a rearwardly swept inner blade region and a highly forwardly swept outer blade region. The outer blade region is further characterized by a blade chord that increases with increasing radius.

This blade design provides a particularly effective combination of high efficiency, low noise, and compactness (i.e. thin profile due to low pitch width at the blade tip). The design provides a very high forward sweep at the tip, and thus the advantages of efficiency and low noise of a highly forwardly skewed fan. At the same time, the design provides a far more axially compact profile than conventional forwardly skewed fans, in part due to the abrupt transition to forward sweep in combination with an increasing blade chord. The use at the blade tip of a very high forward sweep in combination with an increasing blade chord provides better attachment of airflow and helps to prevent recirculation around the tips. Moreover, the abrupt transition allows a more extreme forward sweep at the tip while avoiding a significant region of low sweep. Performance is relatively insensitive to the nature of the transition (continuous and smooth versus discontinuous and sharp-cornered), so long as the transition is confined to a short segment.

Other features and advantages of the invention will be apparent from the following description of a preferred embodiment and from the claim.

DESCRIPTION OF THE PREFERRED EMBODIMENT

Figures

Structure

The fan 10 described in FIGS. 1–4 is a multi-(e.g., 10) bladed fan for use adjacent a heat exchanger 12, e.g., for cooling associated with an automobile condenser or radiator system Blade 14 is attached to hub 18, and both rotate in direction Z about center X.

Figure 1:
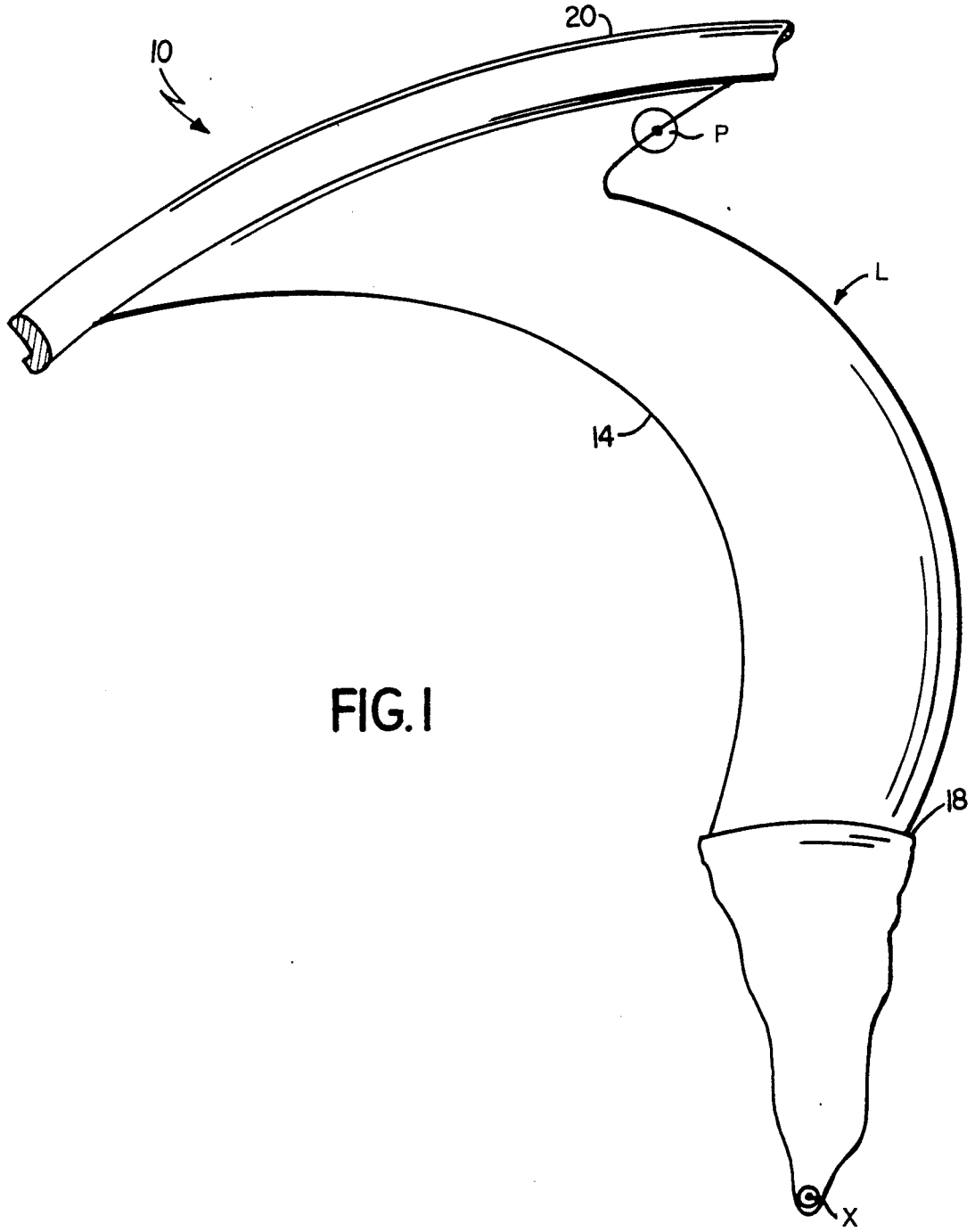
FIG. 1 is a diagrammatic representation of a fan blade according to the invention.
Figures 1A, 1B:
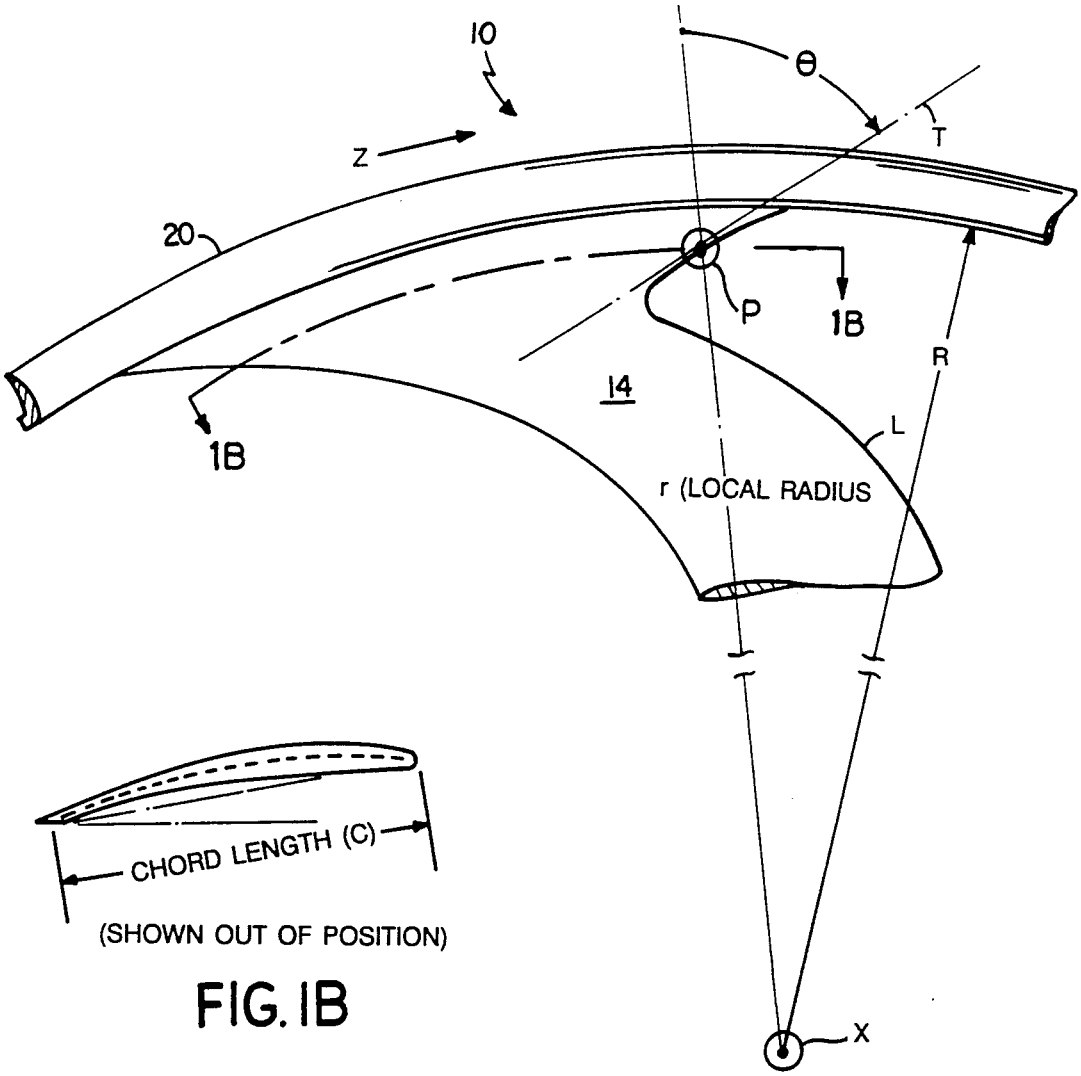
FIG. 1A is a diagram of a portion of FIG. 1.
FIG. 1B is a section along 1B—1B of FIG. 1A.
Figure 2:
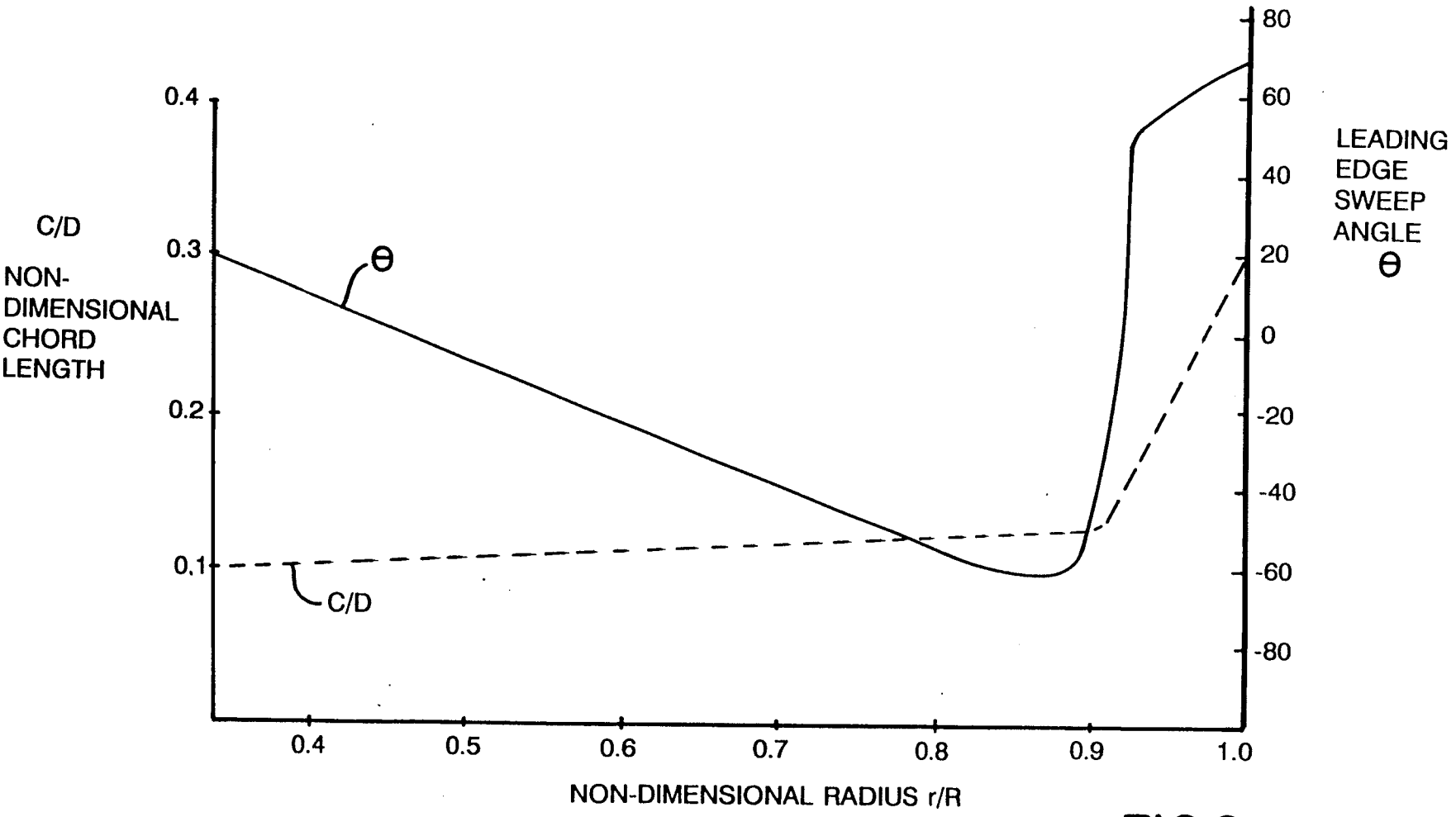
FIG. 2 is a plot which shows leading edge sweep angle ($\theta$) and non-dimensional chord length (C/D) as a function of non-dimensional radius (r/R).
Figure 3:
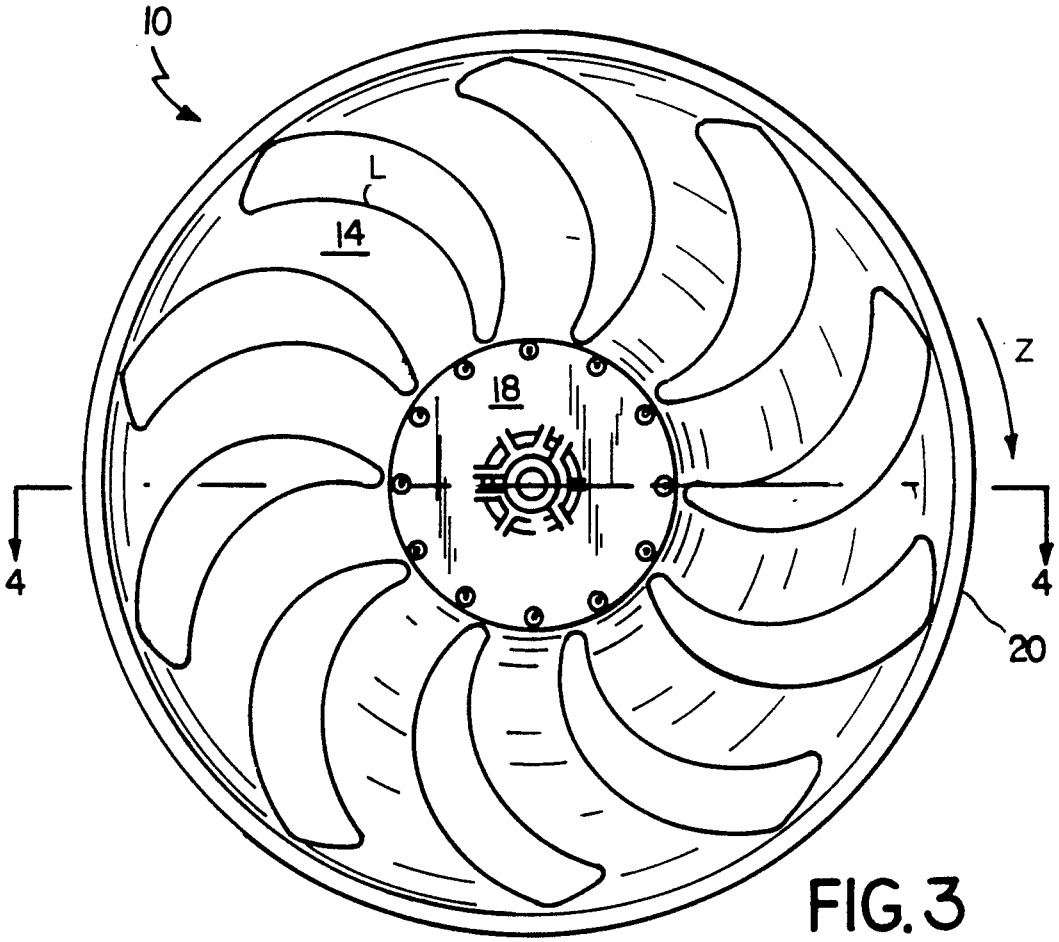
FIG. 3 is a front view of the fan depicted in FIG. 1.
Figure 4:
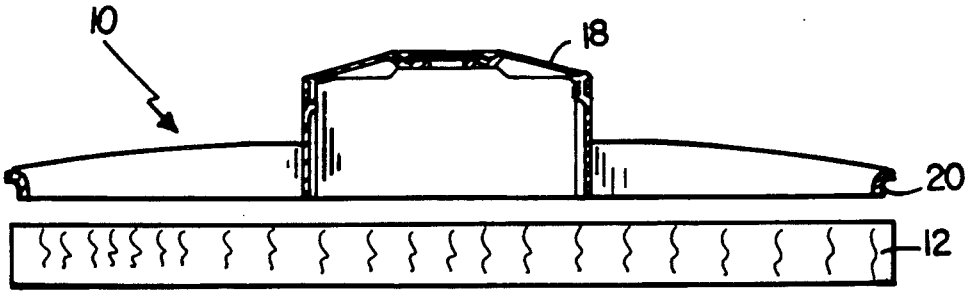
FIG. 4 is a section of the fan of FIG. 1 taken along 4—4 of FIG. 3.

The blades 14 of fan 10 may be, but need not be, identical, and one is shown in FIG. 1. The leading edge L of blade 14 is highly swept, as defined by the leading edge sweep angle $\theta$ (see FIG. 1A) formed between a radial line through at point P on leading edge L and a tangent T to leading edge L at point P. Radial position along blade 14 is defined by the non-dimensional radius r/R at a point, where r = the local radius distance to the point, and R = the fan radius. FIG. 1B shows the blade chord ("C") which is the length of a nose-to-tail line along a constant radius arc. D is the fan diameter.

Toward the tip of blade 14, where the blade velocity and therefore noise are greatest, the leading edge is highly swept. For example at substantially all points where $r/R > 0.85$ (and even $r/R > 0.75$), the absolute value of the leading edge angle is over 40°, with the exception of a short transition segment of the leading edge (a segment less than 2% of the blade length) in which the leading edge sweep angle changes abruptly between a high forward sweep and a high rearward sweep.

The abrupt change in $\theta$ does not result in a significant adverse effect on performance. The extremely high forward sweep at the blade tip ($\theta > 50°$) is advantageous for improving efficiency, probably by providing better attachment to the blade and by reducing recirculation. Band 20 which connect the blade tips and extends circumferentially around the fan also reduces recirculation. Band 20 also improves the strength of the fan.

Particularly preferred embodiments of the invention have the following characteristics.

The forward sweep in the outer blade region (i.e. $\theta$) is at least 20°, more preferably at least 30° and most preferably at least 40°. The forward sweep is not merely an artifact of the radius of curvature at the tip-to-band connection, and the above-defined forward sweep extends over at least 5% of R in the outer blade region.

Also preferably, the rearward sweep (i.e. $\theta$) in the inner blade region is at least $-10°$ and more preferably is at least $-20°$ at a point positioned a distance less than 10% of R from a point in the outer blade region where $\theta$ is at least 25°. Another measure of the abruptness of the transition is that $\theta$ preferably changes more than 40° over a distance of less than 4% of R. Most preferably $\theta$ is $>40°$ at a point between $r/R = 0.94$ and 0.98, and $\theta$ is less than $-30°$ at a point between $r/R = 0.60$ and 0.70.

Additionally, the point in the transition region at which $\theta$ changes from negative to positive is preferably at $r/R = 0.7$ or greater.

Preferably, the blade chord increases at least 20% over the range $r/R = 0.70$ to $r/R = 0.98$.

The above-described fan design is generally useful with a rotating tip band and it generally includes means for mounting the fan adjacent a heat exchanger, e.g. bolts to fasten the fan to a shroud.

The following table is provided to illustrate the invention with one particular fan, and not to limit the invention. The table shows the leading edge sweep angle $\theta$ from the hub (r/R=0.373) to the tip (r/R=1.0)

| r/R | Θ | r/R | Θ |
|---|---|---|---|
| .373 | 14.06 | .703 | −38.25 |
| .406 | 8.95 | .736 | −42.76 |
| .439 | 4.47 | .769 | −48.35 |
| .472 | −1.14 | .802 | −53.02 |
| .505 | −7.62 | .835 | −58.35 |
| .538 | −13.12 | .868 | −63.14 |
| .571 | −18.30 | .901 | −46.43 |
| .604 | −23.43 | .917 | −11.64 |
| .637 | −28.55 | .934 | 54.16 |
| .670 | −33.36 | .967 | 61.19 |
| | | 1.000 | 67.82 |

The fan may be manufactured by conventional plastic molding techniques well known to those in the field.

OTHER EMBODIMENTS

Other embodiments are within the following claims. For example, the invention can be used to force air through a heating and air conditioning system, in which case the heat exchanger arrangement would be different from that depicted in the figures. The fan need not be banded, although a band is preferred. The abrupt transition in $\theta$ need not be a continuous function. For example, it can be a sharp discontinuity formed at the intersection of two curved lines, so that the transition region effectively is a point.

The invention is not specifically dependent on the thickness distribution or camber distribution along the chord, because these factors are generally (within reasonable limits) not critical. Accordingly, the following claims cover fans regardless of their thickness or camber distribution. The blade may have a discontinuous camber line, particularly in the outer blade region so as to reduce the effective pitch of the blade and to maintain a narrow axial profile at the tip.

I claim:

1. A fan comprising an inner hub designed to rotate in a predetermined rotation direction, the hub being attached to blades extending outwardly from the hub to blade tips, the blades being characterized by:

(a) an outer forwardly swept blade region having a leading edge sweep angle $\theta$ that is swept in the predetermined rotational direction at an angle of at least 20°;

(b) a rearwardly swept inner blade region in which the leading edge sweep angle $\theta$ is swept away from the predetermined rotational direction;

(c) a transition blade region extending from the outer blade region to the inner blade region, the length of the transition blade region is no greater than 0.01 R, where the transition blade region is measured from an outer blade region where $\theta$ is at least 20° to an inner blade region that is rearwardly swept so that the leading edge sweep angle $\theta$ is −10° or less, and where R=the fan radius; and (d) a blade chord which increases with increasing radius in the outer blade region.

2. The fan of claim 1 in which $\theta$ changes at least 40° over a radial distance of less than 4% of R.

3. The fan of claim 1 in which $\theta$ is at least 30° over a distance of at least 0.05 R in the outer blade region.

4. The fan of claim 3 in which $\theta$ is −20° or less at a point in the inner blade region which is positioned a distance less than 0.10 R from a point in the outer blade region at which $\theta$ is greater than 25°.

5. The fan of claim 1 in which $\theta$ is −20° or less at a point in the inner blade region which is positioned a distance less than 0.10 R from a point in the outer blade region at which $\theta$ is greater than 25°.

6. The fan of claim 1 in which the blade chord increases at least 20% over the range r/R 0.70 to r/R=0.98, where R=the radius to a radial position along the blade and R=the fan radius.

7. The fan of claim 1 in which $\theta$ becomes positive at a point in the transition region where r/R is greater than 0.7.

8. The fan of claim 1 in which $\theta$ is greater than 40° at a point between r/R=0.94 and r/R=0.98, and $\theta$ is less than −30° at a point between r/R=0.60 and 0.70.

9. The fan of any one of claim 1, 8 or 4 further comprising a rotating tip band.

10. The fan of any one of claims 7 or 4 further comprising means to mount said fan adjacent a heat exchanger.

* * * * *